US008869450B2

(12) United States Patent
Balay et al.

(10) Patent No.: US 8,869,450 B2
(45) Date of Patent: Oct. 28, 2014

(54) OVERHEAD DOOR WITH STACKING PANELS

(71) Applicant: CIW Enterprises, Inc., Mountaintop, PA (US)

(72) Inventors: Joseph L. Balay, Sugarloaf, PA (US); Joseph D. Kondash, Wilkes-Barre, PA (US); Ian Klish, Nanticoke, PA (US); Thomas Balay, Drums, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 94 days.

(21) Appl. No.: 13/855,266

(22) Filed: Apr. 2, 2013

(65) Prior Publication Data

US 2014/0290878 A1 Oct. 2, 2014

(51) Int. Cl.

| | |
|---|---|
| ***E06B 9/26*** | (2006.01) |
| ***E04H 12/18*** | (2006.01) |
| ***E06B 3/48*** | (2006.01) |
| ***E05F 15/00*** | (2006.01) |

(52) U.S. Cl.

CPC ..... *E06B 3/483* (2013.01); *E05F 15/00* (2013.01)

USPC ..... 49/199; 160/33; 49/125; 49/198

(58) Field of Classification Search

USPC ..... 160/32, 33, 35, 36; 49/197, 198, 199, 49/125, 126, 127, 128

See application file for complete search history.

(56) References Cited

U.S. PATENT DOCUMENTS

| | | | | | |
|---|---|---|---|---|---|
| 955,991 | A | * | 4/1910 | Pheils | 454/339 |
| 974,327 | A | * | 11/1910 | Woods | 160/193 |
| 1,033,115 | A | * | 7/1912 | Mowry | 160/193 |
| 1,352,692 | A | * | 9/1920 | Posson | 49/127 |
| 1,413,354 | A | * | 4/1922 | Posson | 49/127 |
| 1,628,511 | A | * | 5/1927 | Petersen | 160/32 |
| 1,743,696 | A | * | 1/1930 | Vetterlein | 160/202 |
| 1,929,071 | A | * | 10/1933 | Levy | 160/34 |
| 2,020,544 | A | * | 11/1935 | Gill et al. | 160/191 |
| 2,237,800 | A | * | 4/1941 | Webber | 160/9 |
| 2,672,192 | A | * | 3/1954 | Goldner | 160/32 |
| 2,729,287 | A | * | 1/1956 | Goldner | 160/33 |
| 2,897,886 | A | * | 8/1959 | Pistelli | 160/33 |
| 3,000,437 | A | * | 9/1961 | Bennett | 160/33 |
| 3,237,681 | A | * | 3/1966 | Huse | 160/193 |
| 3,280,888 | A | * | 10/1966 | Davis | 160/35 |
| 3,491,400 | A | * | 1/1970 | Hubbard | 16/96 R |
| 3,738,413 | A | * | 6/1973 | Frobosilo et al. | 160/35 |
| 3,842,891 | A | * | 10/1974 | Kinnroth et al. | 160/35 |
| 4,068,699 | A | * | 1/1978 | Tucker | 160/33 |
| 4,083,148 | A | * | 4/1978 | Saucier | 49/125 |
| 4,139,042 | A | * | 2/1979 | Watanabe et al. | 160/36 |
| 4,379,478 | A | * | 4/1983 | Lichy | 160/35 |
| 4,460,030 | A | * | 7/1984 | Tsunemura et al. | 160/35 |
| 4,538,661 | A | * | 9/1985 | Henry et al. | 160/35 |
| 4,603,723 | A | * | 8/1986 | Sugihara | 160/35 |

(Continued)

*Primary Examiner* — Katherine Mitchell
*Assistant Examiner* — Justin Rephann
(74) *Attorney, Agent, or Firm* — Mitchell A. Smolow

(57) ABSTRACT

An overhead door system featuring independent, unconnected panels is described. Each panel end is operatively carried within a pair of parallel tracks. The weight of the door decreases as the door is lifted and each panel completely disengages from its adjacent panel as it reaches the stacked position. This allows for a linear spring torque to door weight relationship requiring a very small motor compared to existing designs to provide the lifting torque necessary to operate the door.

29 Claims, 3 Drawing Sheets

(56) References Cited

U.S. PATENT DOCUMENTS

| | | | | | |
|---|---|---|---|---|---|
| 4,662,420 | A | * | 5/1987 | Hirao | 160/32 |
| 4,787,119 | A | * | 11/1988 | Furuya | 16/102 |
| 4,838,331 | A | * | 6/1989 | Kasai | 160/36 |
| 5,022,454 | A | * | 6/1991 | Kobayashi et al. | 160/202 |
| 5,065,806 | A | * | 11/1991 | Kondoh | 160/36 |
| 5,072,766 | A | * | 12/1991 | Kondoh et al. | 160/36 |
| 5,133,398 | A | * | 7/1992 | Yang et al. | 160/33 |
| 5,172,742 | A | * | 12/1992 | Iwasaki et al. | 160/36 |
| 5,291,686 | A | * | 3/1994 | Sears et al. | 49/322 |
| 5,685,355 | A | * | 11/1997 | Cook et al. | 160/202 |
| 6,279,640 | B1 | * | 8/2001 | Van Lennep | 160/62 |
| 6,311,757 | B1 | * | 11/2001 | Schuette et al. | 160/202 |
| 6,339,905 | B1 | * | 1/2002 | Craig | 52/174 |
| 7,950,438 | B2 | * | 5/2011 | Albert | 160/201 |
| 8,327,908 | B2 | * | 12/2012 | Godovalov | 160/201 |
| 8,468,751 | B2 | * | 6/2013 | Williams | 52/71 |
| 2003/0029582 | A1 | * | 2/2003 | Aquilina | 160/201 |
| 2005/0126721 | A1 | * | 6/2005 | Fan | 160/201 |
| 2012/0047804 | A1 | * | 3/2012 | Talboys | 49/25 |

* cited by examiner

OVERHEAD DOOR WITH STACKING PANELS

FIELD OF THE INVENTION

This invention relates generally to overhead doors, and in particular, to an overhead door with stacking panels.

BACKGROUND OF THE INVENTION

Overhead doors are utilized to provide security and access control in institutional, industrial and commercial buildings. They fall into two general design categories: coiling doors and segmented panel doors. Each have their advantages and disadvantages making one better suited for a given design application.

Often times a segmented panel door is better suited for a particular application but cannot be used due to the increased space requirement needed to house the panels once the door is opened. Various attempts have been made to reduce the profile of the opened door, such as stacking the panels as taught in U.S. Pat. No. 4,460,030 to Tsunemura et al. and in U.S. Pat. No. 5,685,355 to Cook et al.

The stacking design of those two patents, as do all other known panel stacking designs, maintain a connection point between the panels such as a hinge, or otherwise link the opened panels, for example, with chains, to support the weight of the panels during opening.

Having to maintain a connection point between the panels presents many disadvantages such as placing limitations on the ease of repair of damaged panels and requiring higher energy consuming operators to open the door. Accordingly, there is still a continuing need for improved stacking panel overhead door designs. The present invention fulfills this need and further provides related advantages.

BRIEF SUMMARY OF THE INVENTION

The following disclosure describes a stacking panel overhead door design wherein the panels are independent of one another.

One advantage of unconnected stacking panels is the spring torque to door weight ratio is easy to control. The weight of the door decreases as the door is lifted and a panel disengages completely from its adjacent panel as it reaches the stacked position. This allows for a linear spring torque to door weight relationship requiring a smaller motor compared to existing designs to provide the lifting torque necessary to operate the door, thereby providing concomitant energy savings. Chart A represents the spring torque to door weight ratio.

A second advantage of independent stacking panels is the ease of replacement or repair of a damaged panel.

Other features and advantages of the present design will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Chart A represents an ideal spring torque curve.

Figure 1:
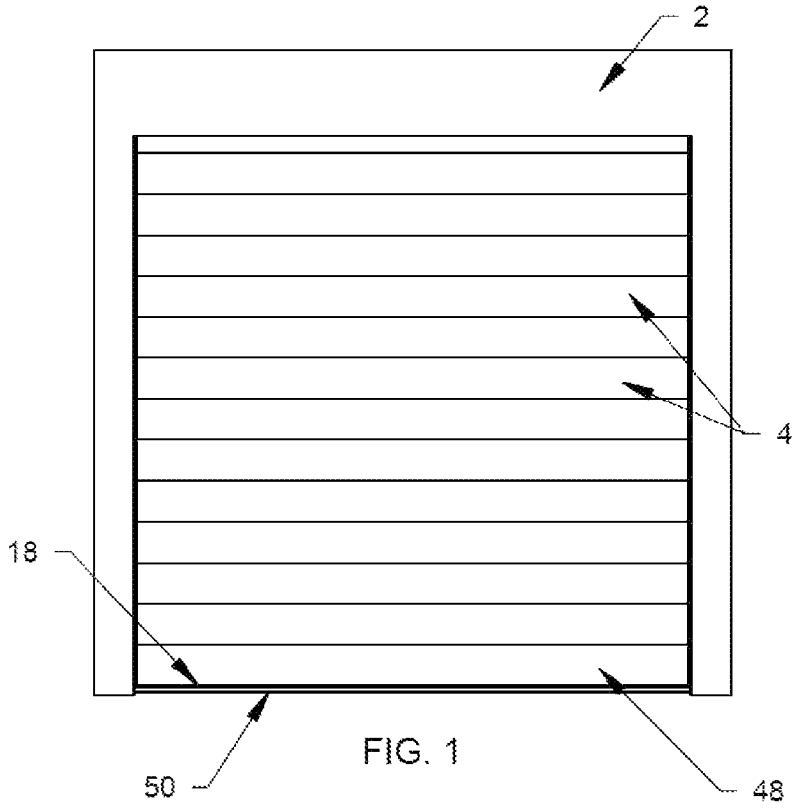
FIG. 1 is a front view of the overhead door system.

Other features and advantages of the present invention will be apparent from the following more detailed description of the preferred embodiments, taken in conjunction with the accompanying drawings which illustrate by way of example the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale and some features may be exaggerated to show details of particular components. Therefore, specific structural and functional details disclosed are not to be interpreted as limiting but merely as a basis for the claims and as a representative basis for teaching one skilled in the art to variously employ the present invention. Where possible, like reference numerals have been used to refer to like parts in the several alternative embodiments of the present invention described herein.

Figure 6:
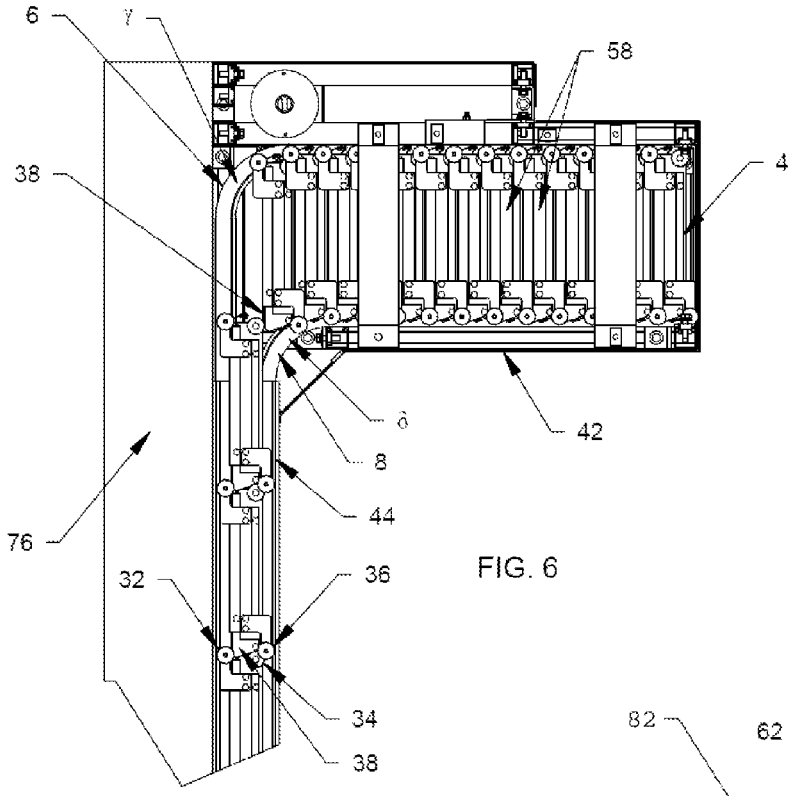
FIG. 6 is a side view of stacked door panels in the open position.

Turning now to FIG. 1, in a preferred embodiment, the overhead door 2 comprises a plurality of unconnected panels 4 which operatively travel at each end within a first 6 and second 8 track (FIG. 6).

Figure 2:
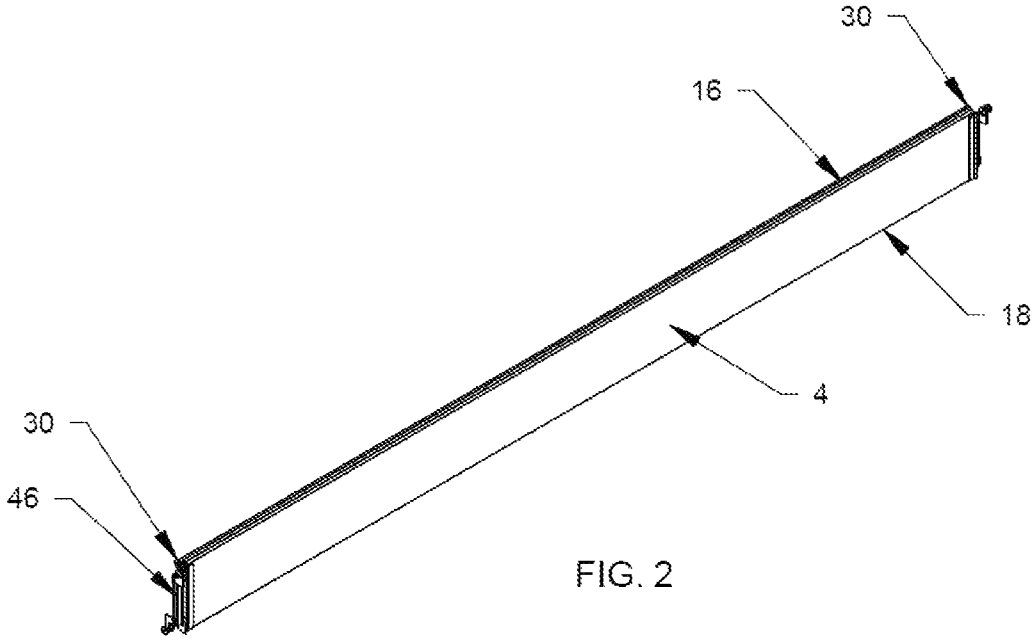
FIG. 2 is a perspective view of a panel.
Figure 3:
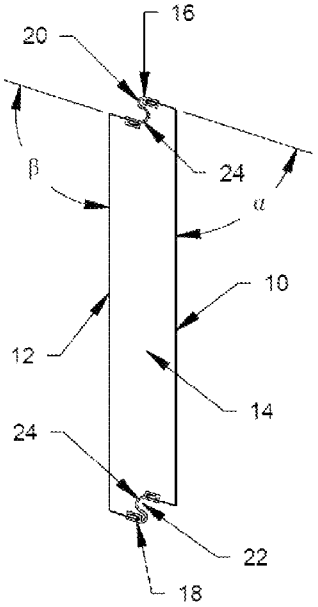
FIG. 3 is an end view of a panel without the end cap.

As shown in FIGS. 2 and 3, each panel 4 comprises an outer 10 and inner 12 surface with preferably an insulating material 14 in-between. A top 16 and bottom 18 edge each comprise a geometry that allows for engagement and disengagement of its adjacent panel during operation.

Figure 5:
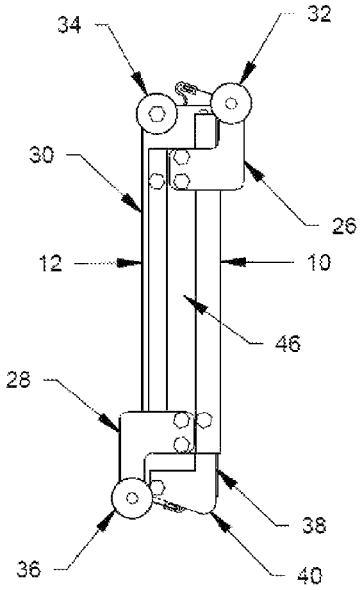
FIG. 5 is a front view of an end cap with the roller assemblies.

Turning to FIG. 5, end caps 46 are fastened at each panel end. While end caps 46 in and of themselves are not required for operability, the end caps 46 provide esthetic advantages, operative engagement advantages, and fewer panel component parts. When the panels 4 are stacked, the end caps 46 contact each other, not the panels 4, thereby limiting the bumping and disfigurement of the panels 4. Instead of the time consuming task of separately mounting a first 26 and second 28 positioning assembly, activation engagement member 34, and panel guide 38 (described in detail below) to each panel 30, a prefabricated end cap 46 containing those components is fastened to each panel end 30. The end caps 46 are preferably molded of high impact plastic.

All panels 4, including the bottom panel 48 are interchangeable to allow for easy removal of a damaged panel and replacement. The bottom panel 48 (FIG. 1) includes a removably attached weather seal and/or sensing edge 50 affixed to its bottom edge 18 that is removed and reattached to the replacement bottom panel. The end caps 46 of the bottom panel 48 are operatively engaged to a drive mechanism 64 (FIG. 7), for example a cable, chain, belt, or piston.

Figure 7:
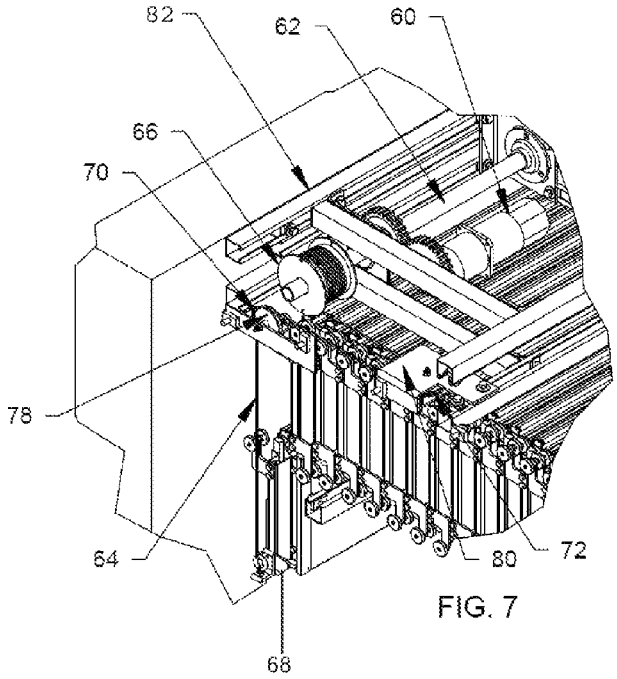
FIG. 7 is a perspective view of the drive mechanism.

When the drive mechanism 64 is a cable, the cable arrangement provides the cable 64 an effective operative cable geometry that will allow the cable 64 to operatively wrap on a cable drum 66. As shown in FIG. 7, to achieve this, in a preferred embodiment, the cable 64 is positioned vertically from the panel cable attachment 68, around a first pulley 70 mounted to a vertical pulley bracket 78, and then around a second pulley 72 mounted to a horizontal pulley bracket 80 and positioned about 15 inches to about 17 inches, optimally about 16 inches behind a wall attachment 82 before the cable 64 wrap on the cable drum 66.

Figure 4:
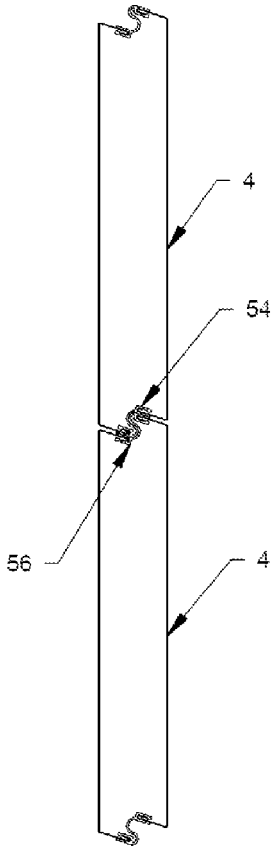
FIG. 4 is a side view of two engaged panels without the end cap.

Turning to FIGS. 3 and 4, for the top edge geometry a lip 20 is angled in relation to outer panel surface 10 forming angle α. Likewise, trough 22 is angled in relation to inner panel surface 12 forming angle β. For the bottom edge geometry the lip 20 is angled in relation to inner panel surface 12 forming angle α. Trough 22 is angled in relation to outer panel surface 10 forming angle β. When two panels 4 are fully engaged (FIG. 4) the lip 20 of the first panel nests intimately within the trough 22 of its adjacent panel. The lip 20/trough 22 geometry allows adjacent panels to nest and prevents engaged panels from separating, thereby insuring security, improving the wind load rating, and providing added weather protection. Preferably, a thermal break piece 24, shown in FIG. 3, is attached to each panel 4. Multiple points of contact between the panel top edge thermal break piece 54 and panel bottom edge thermal break piece 56 increase the surface area of the joint to provide a more complete air infiltration seal. In the preferred embodiment, top and bottom thermal break pieces 54, 56 are fabricated from PVC.

To insure proper panel engagement/disengagement during door closing and opening and to prevent water from traveling from the outside environment to the inside environment, angles α and β are about 10 degrees to about 25 degrees, preferably about 15 degrees to about 20 degrees and optimally about 18 degrees.

While the following elements may be attached directly to a panel 4, for the advantages described above, in a preferred embodiment they are fabricated as part of the end cap 46. As shown in FIG. 5, a first 26 and second 28 positioning assembly, for example, bearing assemblies, are attached to each end 30 of panel 4. The first positioning assembly 26 comprises a first engagement member, for example, a bearing 32, extending outward from panel outer surface 10 to operatively engage the first track 6. An activation engagement member, for example, an activation bearing 34, is positioned to operatively engage the panel guide 38 of the adjacently superior panel during opening and closing of the door 2.

Activation engagement member 34 aids in engaging/disengaging the lip 20 and trough 22 of adjacent panels by riding on the panel guide 38 around the panel bottom edge radius 40 to nest the panels in the fully engaged (door closed) position. Bearing 34 remains in contact with panel guide 38 in the stacked position, the fully closed position, and throughout the panel engagement/disengagement operation.

The second positioning assembly 28 comprises an engagement member, for example, a bearing 36, extending inward from the panel inner surface 12 to operatively engage the second track 8.

Although optional panel stiffeners may be added to the panel 4, the present design does not require any stiffeners to be operatively effective, providing additional benefit over known sectional door designs which require stiffeners to achieve equivalent wind load ratings. In a preferred embodiment the insulating material 14 comprises an expandable foam injected between the outer 10 and inner 12 panel surface. While bearings have been used as exemplars for the engagement members, any low friction member, for example, PTFE pads are also contemplated.

Turning now to FIG. 6, each set of first 6 and second 8 tracks are fixed to both sides of a door opening frame member 76 in known fashion. In a horizontal section 42 of tracks 6, 8, the tracks 6, 8 are separated by a distance equal to the width of a panel 4. In a vertical section 44 of tracks 6, 8, the tracks 6, 8 are separated by a distance equal to the thickness between the first engagement member (bearing) 32 and the second engagement member (bearing) 36. The transition between the horizontal section 42 and the vertical section 44 is accomplished through radii γ and δ. Ideally, the radii γ and δ are sized to support only two panels 4 simultaneously. The ideal spring torque curve indicated by Chart A is most closely achieved by having as few panels simultaneously engage radii γ and δ as possible. Since effective disengagement of adjacent panels will not occur if radii γ and δ are sized to only accept one panel, two panels is optimum.

The optimal sizing of the radii γ and δ allows for the advantageous reduced force required to operate the door 2. Larger radii would require increased initial force to hold the panels, thereby causing the spring torque to door torque to become out of balance near the closed position as those panels are no longer traveling within the radii. Larger radii would also increase the height of the stacked panels 4 above the door opening creating the need for additional overhead space. In the preferred embodiment, the radii γ and δ are about three inches to about five inches, and optimally, about four inches. Along with providing the optimal spring torque to door torque ratio, the optimal radii allow the footprint of the panel stack 58 to fit within the current requirements for a typical rolling steel door construction, thereby allowing easy retrofit.

In operation of a preferred embodiment, to close the overhead door 2 a motor 60 turns a shaft 62 in a direction to unwind a cable 64 from a cable drum 66 attached to the shaft 62. The bottom panel 48 gravity closes as the cable 64 unwinds. The bottom panel 48 maintains the panel immediately superior to it in the panel stack 58 until the point of transition to the engaged position. As the lip 20 and trough 22 of adjacent panels 4 become engaged, the process begins again as the newly engaged panel maintains its immediately superior panel in the panel stack 58 until the point of transition to the engaged position. The process repeats until all of the panels necessary to close the opening are in place.

To open the door 2, the opposite occurs. As the motor 60 turns the shaft 62 winding the cable 64 onto the cable drum 66 the bottom panel 48 is raised thereby raising all the panels above it. As a panel 4 travels through the radii γ and δ, the activation bearings 34 located at each panel end disengage the lip 20 and trough 22 of adjacent panels as the activation bearings 34 ride on the panel guide 38 around the panel bottom edge radius 40. As each succeeding panel is disengaged it pushes the preceding panel into and forms the panel stack 58.

In this manner, the weight of the door 2 decreases as each panel 4 disengages and joins the panel stack 58. This allows for easier control of the spring torque to door weight ratio. This linear relationship (indicated by Chart A) requires a much smaller motor to provide the lifting torque necessary to operate the door when compared to known technology where the panels cannot separate from one another.

Because the panels 4 are independent from and unconnected to one another, repair or replacement is easily and quickly accomplished. Returning to FIG. 6, in the door open position each independent stacked panel 4 can be slid out the rear of the stack until the damaged panel is retrieved. Once repaired or replaced, the removed panels 4 are easily and quickly replaced within the track. No time is lost to removing hinges or otherwise disconnecting and reconnecting one panel to adjacent panels as required with existing technology.

Although the present design has been described in connection with specific examples and embodiments, those skilled in the art will recognize that the present design is capable of other variations and modifications within its scope. For example, although a cable lifting mechanism has been described, any motion that provides for raising and lowering the bottom panel is contemplated. These examples and embodiments are intended as typical of rather than in any way limiting on the scope of the present design as presented in the appended claims.

What is claimed is:

1. An overhead door comprising:

a plurality of unconnected panels, each panel comprising an outer and inner surface, a top and bottom edge, each top and bottom edge comprising a geometry engaging and disengaging an adjacent panel bottom and top edge, respectively, and a first and second end;

a separate first positioning assembly attached to each end, each first positioning assembly comprising a first engagement member extending outward from the panel operatively engaging a separate first track, one separate first track located on each side of the door;

a separate panel guide attached to each end;

a separate activation engagement member attached to each end, each operatively engaging a respective separate panel guide located on each end of an adjacently superior panel engaging and disengaging the adjacent panels; and a separate second positioning assembly attached to each end, each second positioning assembly comprising a second engagement member extending inward from the panel operatively engaging a separate second track, one separate second track located on each side of the door;

wherein the plurality of unconnected panels further comprises a bottom panel comprising an operative attachment member; and every track comprises a radius separating a first track portion from a second track portion, the radius effectively reducing a force required to operate the door and decreasing a stack height.

2. The overhead door of claim 1 wherein:

the top edge comprises a lip angled in relation to the outer surface forming a first angle and a trough angled in relation to the inner surface forming a second angle;

the bottom edge comprises a lip angled in relation to the inner surface forming the first angle and a trough angled in relation to the outer surface forming the second angle.

3. The overhead door of claim 2 wherein each of the first and second angle are about 10 degrees to about 25 degrees.

4. The overhead door of claim 2 wherein each of the first and second angle are about 18 degrees.

5. The overhead door of claim 1 further comprising a thermal break piece attached to each top and bottom panel edge.

6. The overhead door of claim 1 further comprising an end cap attached to each panel end, wherein each end cap comprises the first positioning assembly, the activation engagement member, the panel guide, and the second positioning assembly.

7. The overhead door of claim 6 wherein each end cap further comprises the operative attachment member.

8. The overhead door of claim 1 further comprising a weather seal attached to the bottom panel.

9. The overhead door of claim 1 wherein the first portion of the first track is spaced from the first portion of the second track by a distance operatively accepting a panel width, the second portion of the first track is spaced from the second portion of the second track by a distance operatively accepting the first and second engagement members, and the radius supports only two panels simultaneously.

10. The overhead door of claim 1 wherein the radius is about four inches.

11. The overhead door of claim 1 wherein the positioning assemblies are bearings.

12. An overhead door comprising:

a plurality of unconnected panels, each panel comprising an outer and inner surface, a top and bottom edge, each top and bottom edge comprising a geometry engaging and disengaging an adjacent panel bottom and top edge, respectively, and a first and second end;

a separate first positioning assembly attached to each end, each first positioning assembly comprising a first engagement member extending outward from the panel operatively engaging a separate first track, one separate first track located on each side of the door;

a separate panel guide attached to each end;

a separate activation engagement member attached to each end, each operatively engaging a respective separate panel guide located on each end of an adjacently superior panel engaging and disengaging the adjacent panels;

a separate second positioning assembly attached to each end, each second positioning assembly comprising a second engagement member extending inward from the panel operatively engaging a separate second track, one separate second track located on each side of the door; and a drive mechanism;

wherein the plurality of unconnected panels further comprises a bottom panel comprising an operative attachment member; and every track comprises a radius separating a first track portion from a second track portion, the radius effectively reducing a force required to operate the door and decreasing a stack height.

13. The overhead door of claim 12 wherein the drive mechanism comprises a cable attached at a first end to the attachment member and a second end windingly attached to a cable drum attached to a powered shaft.

14. The overhead door of claim 13 wherein the cable is positioned vertically from the attachment member around a first pulley mounted to a first pulley bracket, then around a second pulley mounted to a second pulley bracket, and then windingly attached to the cable drum.

15. The overhead door of claim 14 wherein the second pulley is positioned about 15 inches to about 17 inches behind a wall attachment.

16. The overhead door of claim 12 wherein:

the top edge comprises a lip angled in relation to the outer surface forming a first angle and a trough angled in relation to the inner surface forming a second angle;

the bottom edge comprises a lip angled in relation to the inner surface forming the first angle and a trough angled in relation to the outer surface forming the second angle.

17. The overhead door of claim 16 wherein each of the first and second angle are about 10 degrees to about 25 degrees.

18. The overhead door of claim 16 wherein each of the first and second angle are about 18 degrees.

19. The overhead door of claim 12 further comprising a thermal break piece attached to each panel end.

20. The overhead door of claim 12 further comprising an end cap attached to each panel end, wherein each end cap comprises the first positioning assembly, the activation engagement member, the panel guide, and the second positioning assembly.

21. The overhead door of claim 20 wherein each end cap further comprises the operative attachment member.

22. The overhead door of claim 12 further comprising a weather seal attached to the bottom panel.

23. The overhead door of claim 12 further comprising a sensing edge attached to the bottom panel.

24. The overhead door of claim 12 wherein the first portion of the first track is spaced from the first portion of the second track operatively accepting a panel width, the second portion of the first track is spaced from the second portion of the second track operatively accepting the first and second engagement members, and the radius supports only two panels simultaneously.

25. The overhead door of claim 12 wherein the radius is about four inches.

26. The overhead door of claim 12 wherein the positioning assemblies are bearings.

27. A method for raising and lowering an overhead door comprising the steps of:

installing a pair of first and second tracks;

inserting a plurality of unconnected panels within the pair of first and second tracks;

installing a drive mechanism; and activating the drive mechanism to raise and lower the overhead door;

wherein;

the plurality of unconnected panels each comprise an outer and inner surface, a top and bottom edge, each top and bottom edge comprising a geometry engaging and disengaging an adjacent panel bottom and top edge, respectively, and a first and second end;

a separate first positioning assembly is attached to each end, each first positioning assembly comprising a first engagement member extending outward from the panel operatively engaging the separate first track, one separate first track located on each side of the door;

a separate panel guide is attached to each end;

a separate activation engagement member is attached to each end, each operatively engaging a respective separate panel guide located on each end of an adjacently superior panel to engage and disengage the adjacent panels; and a separate second positioning assembly is attached to each end, each second positioning assembly comprising a second engagement member extending inward from the panel operatively engaging a separate second track, one separate second track located on each side of the door;

wherein the plurality of unconnected panels further comprises a bottom panel comprising an attachment member operatively engaging the drive mechanism; and every track comprises a radius separating a first track portion from a second track portion, the radius effectively reducing a force required to operate the door and decreasing a stack height.

28. The method of claim 27 wherein the top edge comprises a lip angled in relation to the outer surface forming a first angle and a trough angled in relation to the inner surface forming a second angle;

the bottom edge comprises a lip angled in relation to the inner surface forming the first angle and a trough angled in relation to the outer surface forming the second angle; and the drive mechanism comprises a cable attached at a first end to the attachment member and a second end windingly attached to a cable drum attached to a powered shaft.

29. The method of claim 28 wherein the cable is positioned vertically from the attachment member around a first pulley mounted to a first pulley bracket, then around a second pulley mounted to a second pulley bracket, and then windingly attached to the cable drum.

* * * * *